US008104854B2

(12) United States Patent
Sekiguchi

(10) Patent No.: US 8,104,854 B2
(45) Date of Patent: Jan. 31, 2012

(54) LIQUID-DROPLET JETTING APPARATUS AND LIQUID-DROPLET JETTING METHOD

(75) Inventor: Yasuhiro Sekiguchi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 388 days.

(21) Appl. No.: 11/639,590

(22) Filed: Dec. 15, 2006

(65) Prior Publication Data

US 2007/0139453 A1 Jun. 21, 2007

(30) Foreign Application Priority Data

Dec. 16, 2005 (JP) ..... 2005-362824

(51) Int. Cl.
*B41J 2/195* (2006.01)

(52) U.S. Cl. ..... 347/7; 347/6; 347/9; 347/10; 347/11

(58) Field of Classification Search ..... None
See application file for complete search history.

(56) References Cited

U.S. PATENT DOCUMENTS

| | | | |
|---|---|---|---|
| 6,431,674 | B2 | 8/2002 | Suzuki et al. |
| 6,955,418 | B2 | 10/2005 | Ito |

FOREIGN PATENT DOCUMENTS

| | | |
|---|---|---|
| JP | 2000-85125 | 3/2000 |
| JP | 2004-25636 | 1/2004 |
| JP | 3613297 | 11/2004 |

*Primary Examiner* — Matthew Luu
*Assistant Examiner* — Justin Seo
(74) *Attorney, Agent, or Firm* — Frommer Lawrence & Haug LLP

(57) ABSTRACT

In an ink-jet printer, as a liquid-droplet jetting apparatus, when a predetermined condition is satisfied during an printing operation, a non-jetting drive pulse is applied to an actuator to impart vibration to an ink meniscus of an ink in the vicinity of nozzles without jetting the ink from the nozzles, while a carriage is moving along a width direction of a recording paper. This makes it possible to prevent the drying of the ink in the nozzles without performing flushing operation frequently. Accordingly, the occurrence of printing failure can be lowered and the printing time can be shortened.

18 Claims, 8 Drawing Sheets

LIQUID-DROPLET JETTING APPARATUS AND LIQUID-DROPLET JETTING METHOD

CROSS REFERENCE TO RELATED APPLICATION

The present application claims priority from Japanese Patent Application No. 2005-362824 filed on Dec. 16, 2005, the disclosure of which is incorporated herein by reference in its entirety.

BACKGROUND OF THE INVENTION

1. Field of the Invention:

The present invention relates to a liquid-droplet jetting apparatus, such as an ink-jet printer having a nozzle, which is capable of jetting a liquid droplet, and relates to a liquid-droplet jetting method with respect to such an ink-jet printer for preventing jetting failure due to the drying of the liquid in the vicinity of the opening of the nozzle.

2. Description of the Related Art:

A conventional ink-jet printer is provided with a carriage on which a recording head is mounted. The recording head has a plurality of nozzles for jetting (discharging) ink formed therein, and the ink is filled in pressure chambers communicating with the nozzles, respectively. A drive pulse for jetting the ink is applied to a piezoelectric actuator to deform a deformable portion of the piezoelectric actuator so as to increase and decrease the volume of the pressure chambers, which in turn imparts jetting pressure to the ink in the pressure chambers. This makes the ink to be jetted from the nozzles onto a recording medium while the carriage moves reciprocally.

However, in the recording head, which performs the recording by jetting the ink from the nozzles, there arises a problem such that printing failure is caused by a solvent in the ink (water or the like) which is gradually dried, and thus the ink becomes viscous during a period of time during which no printing is performed and/or in a nozzle through which the ink is jetted less frequently, causing the size of a droplet of the ink (ink droplet) to be smaller than the intended size and/or the ink is jetted less smoothly or less satisfactorily, thereby reducing the printing performance. In such a case, a so-called maintenance operation is performed before performing the printing and/or during the printing operation. The maintenance operation includes, for example, a flushing operation (preliminary jetting) in which the carriage is forcibly or periodically moved to and stand-by at a flushed-ink receiving section located in a non-printing area and then the drive pulse is applied so as to jet the ink forcibly from all the nozzles to perform the flushing; a purge operation in which the carriage is moved to a cap section and then a negative pressure is imparted to the nozzles, thereby forcibly suck and remove air bubbles and/or foreign substance from the nozzles; and the like.

Although the purge operation and flushing operation are effective in removing the foreign substance present or mixed in the ink such as air bubbles, there are problems such that the printing speed is decreased and the ink must be consumed unnecessarily for the non-printing operation because the printing operation must be interrupted to move the carriage to the non-printing area located outside the printing area. In view of these problems, Japanese Patent Application Laid-open No. 2000-85125 and Japanese Patent No. 3613297 (corresponding to U.S. Pat. No. 6,431,674) describe an ink-jet printer in which the ink is prevented from drying and becoming viscous by applying, to the actuator during a period of time in which no ink-jetting is performed, a non-jetting drive pulse which is different from a drive pulse for jetting the ink onto a recording medium and which is a pulse to an extent that no ink is jetted thereby, so as to minutely vibrate a meniscus of the ink (ink meniscus) in the vicinity of the opening of nozzles, thereby preventing the ink from drying and becoming viscous. The term "ink meniscus" means a surface of the ink exposed in the vicinity of the nozzle opening.

In the ink-jet printer described in Japanese Patent Application Laid-open No. 2000-85125, a predetermined electric potential is applied, prior to the ink-jetting, to the actuator (described as "piezoelectric vibration element" in Japanese Patent Application Laid-open No. 2000-85125) such that operations are alternately performed in which the ink meniscus is pulled (drawn) into and pushed back between two positions, namely a reference position and pull-in position, respectively. The reference position is located at a portion further drawn back inside the nozzle opening (position further drawn back on the side of pressure chamber than the nozzle opening surface), and the pull-in positions is located further drawn back inside the nozzle opening with respect to the reference position. By performing such a control, the ink meniscus is minutely vibrated so as to agitate the ink at the nozzle opening, thereby preventing the ink from being dried and becoming viscous.

In the ink-jet printer described in Japanese Patent No. 3613297, the ink meniscus is minutely or slightly vibrated in a minimum cycle in a state that the ink-jet printing apparatus stands still, thereby suppressing the load to the actuator (described as "piezoelectric element" in Japanese Patent No. 3613297) as much as possible while preventing the clogging of the nozzle. Further, the ink is continuously vibrated minutely just before the printing operation is started (resumed), thereby preventing the clogging of the nozzle assuredly.

SUMMARY OF THE INVENTION

As described above, the effort or attempt has been made, by minutely vibrating the ink meniscus prior to the ink-jetting so as to suppress the influence due to the drying of the ink (ink drying), to decrease an amount of the ink consumed unnecessarily, to prevent the printing performance from lowering, and to effectively shorten the time required for printing operation. However, with respect to the minute vibration for a short period of time such that the ink meniscus is minutely vibrated prior to the ink jetting, there are problems that the ink drying cannot be sufficiently prevented and thus the effect for preventing the ink from being viscous cannot be obtained because the ink drying is advanced in a nozzle, among the nozzles, from which the ink is jetted rarely or less frequently during the movement of the carriage.

The present invention has been made in view of the above-described situations, and an object of the present invention is to prevent the drying of a liquid in the nozzles assuredly and to reduce the jetting failure due to the clogging of the nozzle or the like.

According to a first aspect of the present invention, there is provided a liquid-droplet jetting apparatus which jets liquid droplets of a liquid onto a medium, the apparatus including:

- a head having an actuator which applies a pressure to the liquid and a plurality of nozzles which jet the liquid droplets;
- a carriage which is provided with the head and which moves in a predetermined direction; and
- a controller which performs a first control in which a jetting drive pulse is supplied to the actuator so as to jet the liquid droplets from the nozzles onto the medium while the carriage moves in the predetermined direction; and a second control in which, while the carriage moves in the predetermined direction, a non-jetting drive pulse is supplied to the actuator so as to impart vibration to a meniscus of the liquid in the vicinity of the nozzles without jetting the liquid droplets from the nozzles.

According to the first aspect of the present invention, for example, even in a case in which, during an operation in which the head moves reciprocally along a width direction of the medium, only the non-jetting drive pulse without jetting the liquid droplets from the nozzles is supplied to the actuator so as to impart vibration to the meniscus (liquid-meniscus), of the liquid, in the vicinity of the nozzles while making the carriage move at least once in the width direction of the medium, the liquid which is dried in the nozzles and thus in which the viscosity is increased (become viscous) and the liquid which is newly supplied to the nozzles are agitated by the vibration which is applied to all the nozzles and with which no liquid droplets are jetted. Therefore, even when the flushing operation is not performed frequently, it is possible to reduce, substantially constantly, the possibility that the jetting performance (jetting characteristics) is lowered due to the viscous liquid. In addition, since no liquid-droplet is jetted at this time unlike in the flushing operation, it is also possible to reduce an amount of the liquid-droplet consumed unnecessarily for the non-printing operation, and to shorten the operation time because there is no need to interrupt the jetting operation so as to move the jetting head to the flushing position.

Further, since the carriage moves at least once while vibration is being applied to the liquid-meniscus with only the non-jetting drive pulse, it is possible to vibrate and agitate the liquid with respect to all the nozzles for a sufficient period of time. As a result, even in a nozzle, among the nozzle, from which the ink is jetted less frequently, it is possible to prevent the jetting performance from lowering due to the dried and viscous liquid, in an assured manner.

In the liquid-droplet jetting apparatus of the present invention, the predetermined direction may be a width direction of the medium; and the controller may perform the second control after performing the first control. In this case, since the non-jetting drive is performed after the jetting drive, the liquid is agitated in a nozzle, among the nozzles, from which the liquid droplets are not jetted during the jetting drive. Accordingly, it is possible to prevent the lowering of the jetting performance due to the increased viscosity of the dried liquid.

In the liquid-droplet jetting apparatus of the present invention, the controller may control the carriage to move reciprocally, in an outgoing route and a returning route, in the predetermined direction; and the controller may perform the first control while the carriage moves in the outgoing route and perform the second control while the carriage moves in the returning route.

For example, in an ink-jet printer as the liquid-droplet jetting apparatus, when an image such as a photograph image or the like is to be printed in a mode for which high resolution is required, then the printing operation is performed only in the outgoing route but the printing operation is not performed in the returning route. Even in such a case, since only the non-jetting drive pulse is applied to the actuator utilizing the returning route so as to impart the vibration to the ink, any printing failure or unsatisfactory printing hardly occurs at the next or subsequent movement of the carriage, which is particularly effective for the high-resolution printing mode, for example.

In the liquid-droplet jetting apparatus of the present invention, the controller may further include a counter which measures a moving-count of the carriage; and the controller may perform the second control when the moving-count reaches a predetermined value.

In this case, even in a nozzle, among the nozzles, from which the ink is jetted less frequently, it is possible to regularly agitate the liquid which is dried and thus has become viscous, thereby making it possible to constantly prevent the jetting performance from being lowered.

The liquid-droplet jetting apparatus of the present invention may further include a maintenance mechanism which performs maintenance for the head, wherein the controller may have a timer which measures an elapsed time elapsed since last time the maintenance has been performed for the head, and the controller may perform the second control when the elapsed time reaches a predetermined period of time.

In this case, even in a nozzle, among the nozzles, from which the ink is jetted less frequently, it is possible to regularly agitate the liquid which is dried and thus become viscous, thereby making it possible to constantly prevent the jetting performance from being lowered.

In the liquid-droplet jetting apparatus of the present invention, in the second control, the controller may repeat, at a predetermined frequency, a series of operations in which supply of the non-jetting drive pulse to the actuator is repeated predetermined times and then the supply of the non-jetting pulse is stopped for a predetermined supply-stop period. In this case, the actuator is not heated excessively due to the continuous supply of the non-jetting drive pulse, and thus the jetting performance is prevented from lowering.

In the liquid-droplet jetting apparatus of the present invention, the predetermined times may be three times; and the predetermined frequency may be 26 kHz. In this case, the actuator is hardly heated, and thus the jetting performance is prevented from lowering.

In the liquid-droplet jetting apparatus of the present invention, a voltage of the jetting drive pulse may be greater than a voltage of the non-jetting drive pulse. In this case, the jetting drive pulse and the non-jetting drive pulse can be formed by adjusting voltage values of the pulses to be applied to the actuator. Accordingly, the pulse waveform control can be performed easily.

The liquid-droplet jetting apparatus of the present invention may be an ink-jet printer; and the liquid may include black, cyan, magenta and yellow inks. In this case, in an ink-jet printer capable of performing color printing, it is possible to prevent ink-jetting performance from lowering which would be otherwise caused due to the drying of the inks.

According to a second aspect of the present invention, there is provided a liquid-droplet jetting method for jetting liquid droplets of a liquid onto a medium by using a liquid-droplet jetting apparatus which includes: a head having an actuator which applies a pressure to the liquid and a plurality of nozzles which jet the liquid droplets; and a carriage which is provided with the head and which moves in a predetermined direction; the method including:

a moving step in which the carriage moves in the predetermined direction;

a jetting step for jetting the liquid droplets onto the medium while the moving step is being performed;

a vibrating step for imparting vibration to a meniscus of the liquid in the vicinity of the nozzles while the moving step is being performed.

According to the second aspect of the present invention, in all the nozzles, the vibration is imparted to the liquid-meniscus of the liquid so as to agitate the liquid which is dried and thus become viscous in the nozzles and the liquid which newly supplied to the nozzles. Therefore, even when the flushing operation is not performed frequently, it is possible to reduce, substantially constantly, the possibility that the jetting performance is lowered due to the viscous liquid. In addition, since no liquid-droplet is jetted at this time unlike in the flushing operation, it is also possible to reduce an amount of the liquid-droplet consumed unnecessarily for the non-printing operation, and to shorten the operation time because there is no need to interrupt the jetting operation so as to move the jetting head to the flushing position.

DESCRIPTION OF THE PREFERRED EMBODIMENTS

An embodiment of the present invention will be explained as follows with reference to the drawings. First, with reference to FIGS. 1 and 2, an explanation will be given about a construction of an ink-jet printer 1 as the liquid-droplet jetting apparatus of the present invention. In the following explanation, a side from which the ink is jetted (ink-jetting side) is referred to as "lower side" and "lower or downward direction", and a side opposite to the ink-jetting side is referred to as "upper side" or "upper or upward direction". Further, in the present application, the leftward direction and the rightward direction in FIG. 1 are referred to as "leftward direction" and "rightward direction"; and the lower side and the upper side in FIG. 1 are referred to as "front side" and "rear side".

Figure 1:
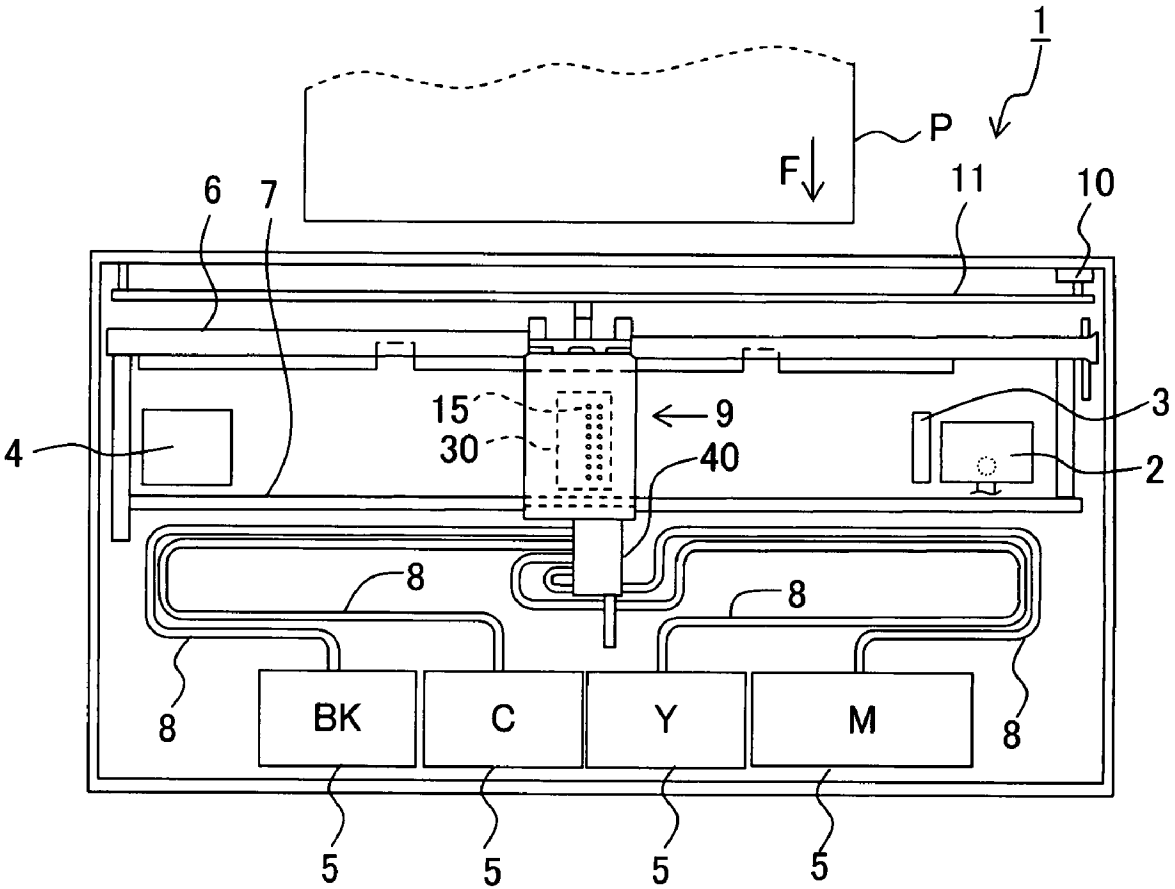
FIG. 1 is a view showing an ink-jet printer 1.

As shown in FIG. 1, two guide shafts 6 and 7 are provided in the ink-jet printer 1. A head holder which functions as a carriage 9 is attached to the guide shafts 6 and 7. A recording head 30 and an ink tank 40 are provided on the carriage 9. The recording head 30 performs recording (printing) by jetting, from nozzles 15, an ink onto a recording paper P as a recording medium. The ink tank 40 accommodates a plurality of different color inks. The carriage 9 is attached to an endless belt 11 which is rotated (driven) by a motor 10. The carriage 9 moves reciprocally along the guide shafts 6, 7 in a direction of a width (width-direction; left and right direction; predetermined direction) of the recording paper P. When the carriage 9 reciprocally moves, a drive pulse for jetting the ink is applied to an actuator 31 (see FIG. 2) of the ink-jet head 30, thereby jetting the ink from the nozzles 15. At this time, the recording paper P is fed or transported (subjected to paper feeding) in a direction indicated by an arrow F by an unillustrated transporting unit provided on the ink-jet printer 1, and the carriage 9 moves reciprocally along the width direction of the recording paper P (left and right direction), thereby performing the printing.

Further, the ink-jet printer 1 is provided with ink cartridges 5 accommodating a plurality of color inks, such as four color inks of a black ink Bk, a cyan ink C, a yellow ink Y and a magenta ink M, respectively. The ink cartridges 5 are connected, to the ink tank 40 provided on the carriage 9, via elastic ink-supply tubes 8 respectively. The inks are stored separately by color in the ink tank 40, and the color inks are supplied to the nozzles 15 such that a predetermined color ink, among the color inks, is supplied to nozzles 15 among the nozzles associated to the predetermined color.

Furthermore, a flushing receiving member 4 for a flushing operation is provided in the ink-jet printer 1 at a non-printing area thereof located at the left side. The flushing operation is performed at the flushing receiving member 4 before the printing is started or during the printing, so as to forcibly or periodically jet the ink from the nozzles 15 formed in the recording head 30 to thereby prevent an inconvenience such as an ink-jetting failure. The flushing receiving member 4 is constructed of a porous material and receives a discarded ink jetted from the recording head 30 during the flushing operation. Moreover, a suction cap 2 is provided on the ink-jet printer 1 at another non-printing area thereof located at the right side, and a suction-purge operation to suck the ink inside the nozzles 15 is performed by using the suction cap 2, to thereby prevent the inconvenience such as the printing failure. The suction cap 2 is provided to be detachable with respect to a nozzle surface of the recording head 30. When the suction cap 2 is in tightly contact with the nozzle surface, the suction operation is performed by using a known pump. Furthermore, there is provided a wiper member 3 which wipes the ink adhered to the nozzle surface after the purge operation.

Figure 2:
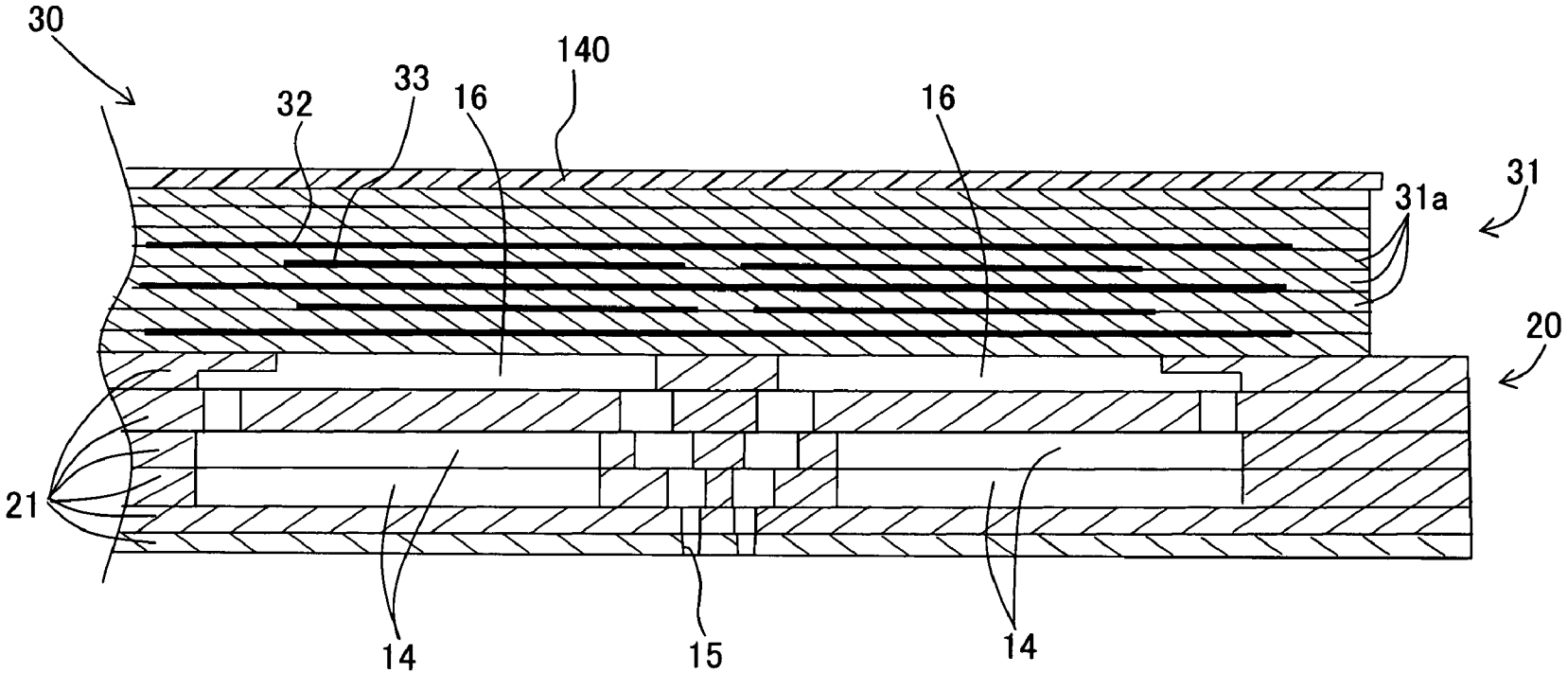
FIG. 2 is a sectional side view of an ink-jet head 30 shown in FIG. 1.

As shown in FIG. 2, similarly to a known ink-jet head described in U.S. Pat. No. 6,955,418 (corresponding to Japanese Patent Application Laid-open No. 2004-25636), the recording head 30 has a plate-type actuator 31, a cavity unit 20, and a flexible printed circuit (FPC) 140. The actuator 31 is adhered to the cavity unit 20 with an adhesive, and the FPC 140 is electrically connected to the upper surface of the actuator 31. The cavity unit 20 has a plurality of plates 21 stacked in a layered form. A lowermost plate 21, among the stacked plates 21, has a plurality of nozzles 15 for jetting the inks formed therein. A plurality of pressure chambers 16, communicating with the nozzles 15 respectively, is formed in the cavity unit 20. Each of the pressure chambers 16 is formed in an uppermost plate 21 among the stacked plates 21, and has an elongated shape in a plan view. Each of the pressure chambers 16 is communicated with one of the nozzles 16 at one end in the longitudinal direction thereof, and is communicated with a manifold channel 14 at the other end in the longitudinal direction thereof. A plurality of pieces of the manifold channel 14 is provided, and the inks are supplied, from the ink tank 40, to the manifold channels 14 respectively. Each of the ink is distributed from one of the manifold channels 14 to pressure chambers 16 among the pressure chambers 16 associated with the manifold channel 14, and then the ink is supplied from the pressure chambers 16 to the nozzles 15, respectively.

The actuator 31 is formed by stacking a plurality of piezoelectric ceramics layers 31*a*, and each of the piezoelectric ceramics layers 31*a* has a thickness of about 30 μm. Individual electrodes 33 and common electrodes 32 are sandwiched alternately between the stacked ceramics layers, to be arranged at positions corresponding to the pressure chambers 16 respectively. The common electrodes are arranged commonly with respect to the pressure chambers. A drive IC chip, in which a drive circuit 49 is packaged, is provided on the FPC 140 and is electrically connected to the electrodes 32 and 33 of the actuator 31. The drive circuit 49 generates a drive pulse which applies electrical voltage between the individual electrodes 33 and the common electrodes 32. By applying the electrical voltage between the individual electrodes 33 and the common electrodes 32, it is possible to deform or displace the ceramic layer 31*a* at active portions thereof sandwiched between these electrodes. With this, volume of the pressure chambers 16 are changed to thereby jet the ink from the nozzles 15.

Figure 3:
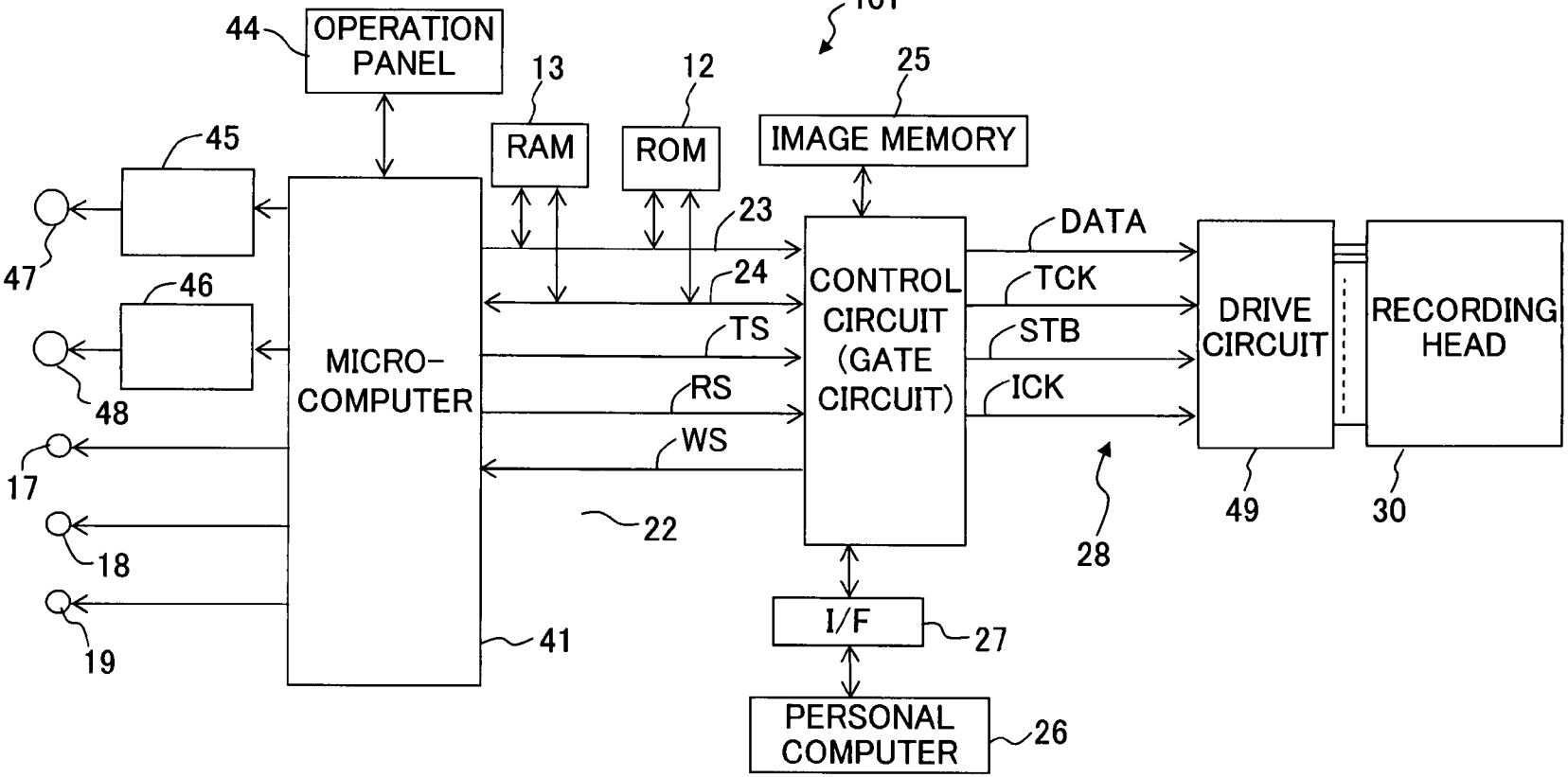
FIG. 3 is a block diagram showing an electrical control of the ink-jet printer 1.

Next, the electrical structure of the ink-jet printer 1 of the embodiment will be explained with reference to FIGS. 3 and 4. FIG. 3 is a block diagram showing the electrical structure of the ink-jet printer 1. A controller 101 of the ink-jet printer 1 includes a one-chip microcomputer (CPU) 41, a control circuit 22 which is a gate-circuit LSI, a ROM 12 storing a control program and drive waveform data for jetting the respective inks, a RAM 13 temporarily storing data, a ROM 25 storing a print data (to be described later), and a drive circuit 49 processing, for example, a strobe signal (to be described later). The CPU 41 is connected with an operation panel 44 via which various instructions is inputted, a motor driver 45 for driving a carriage motor 47 which makes the carriage 9 reciprocally move, a motor driver 46 for a transporting motor 48 which drives the transporting unit, a paper sensor 17 which detects a presence or absence of the printing paper, and an origin sensor 18 which detects whether or not the recording head 3 is at the original position, and an ink cartridge sensor 19 which detects whether or not the ink cartridges 5 are attached in a normal state.

The CPU 41, ROM 12, RAM13 and control circuit 22 are mutually connected via an address bus 23 and a data bus 24. The CPU 41 generates, in accordance with a pre-stored program in the ROM 12, a printing timing signal TS and a control signal RS and transmits the signals TS and RS to the control circuit 22. The control circuit 22 makes the image memory 25 store a printing data transmitted from an external device such as a personal computer 26 via an interface 27. Then, the control circuit 22 generates a interrupt signal WS based on a data transmitted via the interface 27 from the personal computer 26 or the like, and transmits the generated interrupt signal WS to the CPU 41. In accordance with the printing timing signal TS and the control signal RS and based on the printing data which is stored in the image memory 25, the control circuit 22 generates a printing data signal DATA for forming an image, corresponding the printing data, onto the recording-objective medium; a transfer clock TCK which is synchronized with the printing data signal DATA; a strobe signal STB; and a recording waveform signal ICK. Then, the control circuit 22 transmits each of the signals DATA, TCK, STB and ICK to the drive circuit 49.

Figure 4:
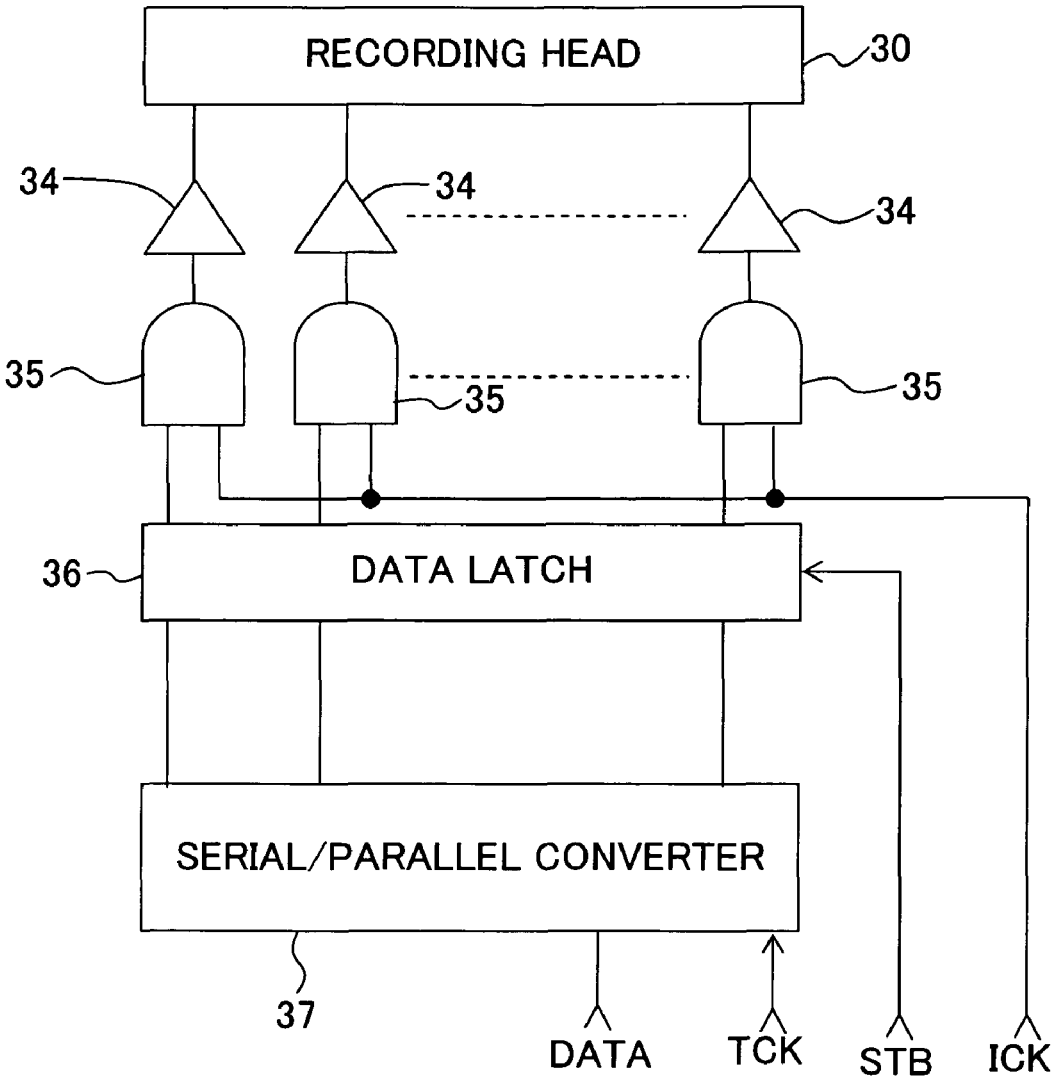
FIG. 4 shows an inner construction of a drive circuit 49 shown in FIG. 3.

FIG. 4 shows the inner structure of the drive circuit 49. The drive circuit 49 includes a serial/parallel converter 37 which converts, to a parallel data, the printing data signal DATA serially transmitted from a data transfer (transmitting) section (not shown in the drawing) in the control circuit 22, in a state that the printing data signal DATA is synchronized with the transfer clock signal TCK; a data latch 36 which latches the converted parallel data based on the strobe signal STB; an AND gate which selectively outputs the printing waveform signal ICK based on the parallel data; and a driver 34 which converts the outputted printing waveform signal to electric voltage suitable for the actuator 31 and outputs the voltage as a drive pulse. The drive pulse, outputted from the driver 34, is applied to the individual electrodes 32 in the recording head 30 so as to deform the actuator 31. The number of each of the serial/parallel converter 37, the data latch 36, the AND gate 35 and the driver 34 is equal to the number of the nozzles in the recording head 30. The drive waveform signal ICK has a drive waveform signal for jetting the ink, and a non-jetting drive waveform signal (to be described later) for vibrating the meniscus in the nozzles to an extent that the ink is not jetted therefrom. The waveform data for forming the drive waveform signal and the non-jetting drive waveform signal are stored in the ROM 12, and are selectively read out in accordance with the program control.

Figure 5A:
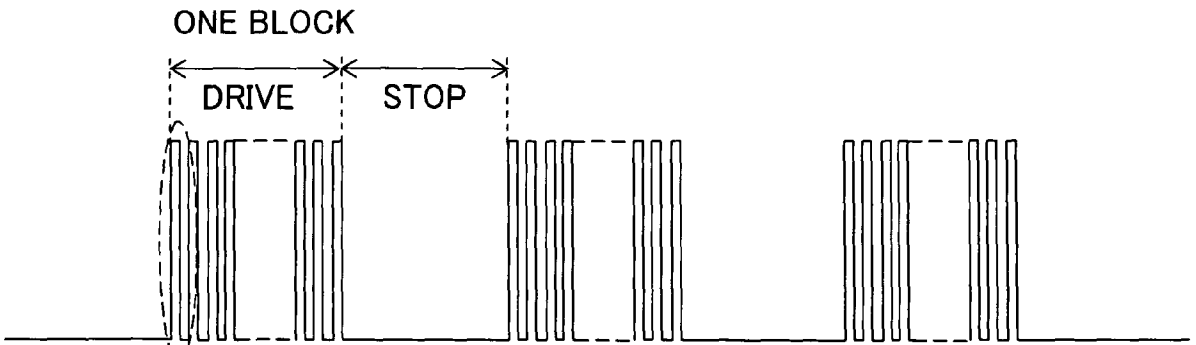
FIG. 5A shows a waveform of a non-jetting drive pulse used in the embodiment.
Figure 5B:
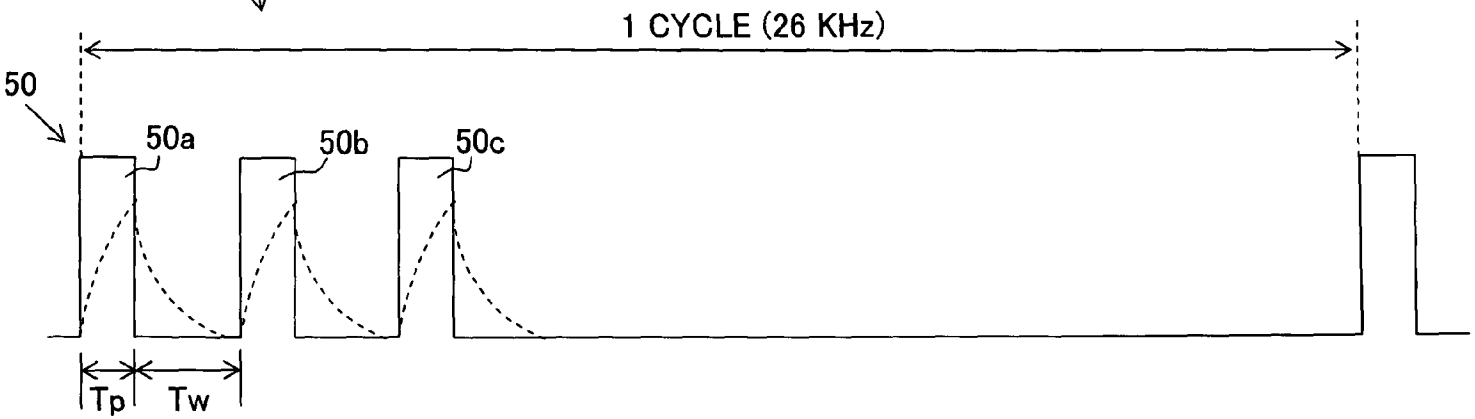
FIG. 5B is a partially enlarged view of FIG. 5A.

FIG. 5A show a waveform of the non-jetting drive pulse, of the embodiment, which is outputted in accordance with the non-jetting drive waveform signal. As shown in FIG. 5B, there are three non-jetting drive pulses, existing in the waveform of the non-jetting drive pulse, namely a first non-jetting drive pulse 50*a*, a second non-jetting drive pulse 50*b* and a third non-jetting drive pulse 50*c*, with respect to a print cycle for one dot (one-dot printing cycle). The drive frequency of the non-jetting drive pulse is 26 KHz and the voltage is 22V. When the actuator 31 is deformed or displaced by the applied drive pulse, to thereby generates a pressure wave in the ink in the pressure chambers, and provided that half (½) a cycle at which the generated pressure wave is varied is AL, a pulse width of one non-jetting drive pulse is Tp, and an interval between the pulses is Tw, then Tp is set within a range of $0.1\ AL \leqq TP \leqq 0.3\ AL$, and the Tw is set within a range of not less than 0.6 AL. It is more desirable that AL is 4 μs, Tp is within a range of 0.8 μsec to 1.2 μsec, and Tw has a value of about 18 μsec.

The actuator 31 is equivalent to a condenser in which the piezoelectric ceramics 31*a* are sandwiched between the electrodes. As with respect to the above-described Tp, when a period of time during which the voltage is applied is short, then as shown FIG. 5B in a broken line, the voltage applied to the actuator 31 consequently falls at a timing at which the voltage has not reached to the maximum voltage for the drive pulse. Accordingly, the pressure acting on the ink in the pressure chamber 16 is only capable of vibrating the ink meniscus in the nozzle, and has an extent with which the ink is not jetted from the nozzle by this pressure. In this embodiment, the voltage is applied to the actuator 31 only for a period of time corresponding to the pulse width Tp. However, it is also possible to apply the voltage to the actuator 31 in an ordinary state to decrease the volume of the pressure chambers 16. Namely, it is possible to repeat an operation for stopping the application of the voltage to the actuator 31 to return the decreased volume of the pressure chambers 16 to its original volume during a period of time corresponding to the drive pulse width Tp and an operation for decreasing the volume of pressure chambers 16 again during a period of time corresponding to the pulse interval Tw.

In the non-jetting drive as described above, a series of operations is repeated in which a drive pulse set (drive pulse group) formed of the three drive pulses is successively outputted for a predetermined number of times at a frequency of 26 KHz; and then stopping the output of the drive pulse set during a predetermined number of cycles. Further, when the output of the pulse set formed of the three non-drive jetting pulses for 100 to 150 cycles is considered as one block, then it is desired to repeat a series of operations, as shown in FIG. 5A, in which the non-jetting drive is performed for the one block, and then the non-jetting drive is stopped at an interval (break interval) of 100 to 150 cycles.

As described above, the non-jetting drive pulse has a pulse width shorter than that of the drive pulse applied for jetting the ink, and the non-jetting drive pulse has a voltage lower than that of the drive pulse. By applying the non-jetting drive pulse having such a waveform to the actuator 31, it is possible to impart, to the meniscus of the ink inside the opening of the nozzle, a vibration to an extent that with which the ink is not jetted, thereby agitating the ink in the vicinity of the nozzle opening and thus preventing the ink disposed inside the nozzle opening from being dried. In addition, by alternately repeating the application of the non-jetting drive pulse during a predetermined number of cycles and stopping the application of the non-jetting drive pulse during a predetermined number of cycles, the agitation of the ink is performed not in a monotonous manner but in a varied manner. Accordingly, it is possible to effectively prevent the drying of the ink.

Next, a printing operation of the embodiment including the non-jetting drive will be explained. In the printing operation of the embodiment, the carriage 9 performs the ink-jetting with respect to the width direction of the recording paper P (left and right direction) under a printing instruction (first control). During such a printing operation, the controller 101 gives an instruction, in accordance with the program stored in the ROM 12, to the actuator 31 to supply only the non-jetting pulse (second control). Even in such a non-printing operation, the carriage 9 moves in the width direction of the recording paper P (left and right direction, predetermined direction) at least once. In other words, during the printing operation, at least for a period of time while the carriage is performing one movement (moving) at least once in the width direction, a non-printing operation (printing operation including a movement of the carriage during which the vibration is given to the ink meniscus in the vicinity of the openings of the nozzles). The term "one movement" referred here means a movement of the carriage in only one of the outgoing route and the returning route in the reciprocal movement of the carriage 9 in the width direction of the recording paper P (left and right direction). Namely, when the carriage 9 moves reciprocally, in the width direction of the recording paper P (left and right direction), starting from a print-start position and then returning again to the print-start position, it is counted as "two movements".

By performing the printing operation in such a manner, it is possible to prevent the ink meniscus formed in the vicinity of the nozzle opening from being dried. In particular, with respect to a nozzle or nozzles 15, among the plurality of nozzles 15, from which the ink is jetted less frequently, the vibration is given to the ink meniscus. Accordingly, it is possible to prevent, with respect to all the nozzles, the jetting from being unstable due to the viscous ink.

Examples of the printing control operation will be explained by using flow charts shown in FIGS. 6 to 8. Programs for print control in the ink-jet printer 1 shown in FIGS. 6 to 8 respectively are each stored in the ROM 12 shown in FIG. 3, and are executed by the CPU 41. In the actual printing control, after the printing operation by the ink-jet head 1 has been started, there are a step for making a judgment whether or not a preliminary jetting such as the flushing operation is needed to prevent the ink-jetting failure, and a step for performing the flushing operation or the like depending on the judgment result. In the examples shown in FIGS. 6 to 8 respectively, however, these steps are omitted.

Figure 6:
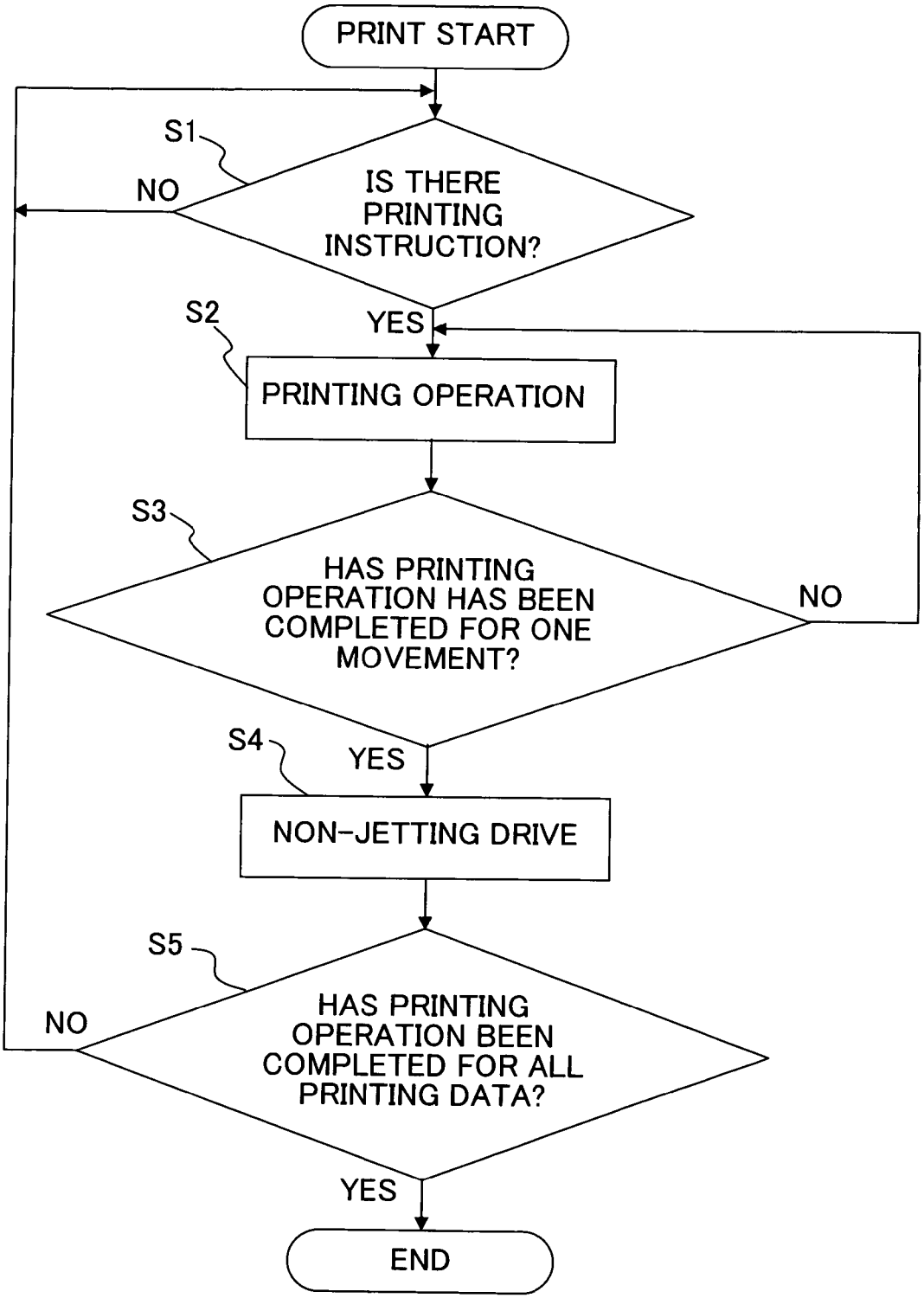
FIG. 6 is a flow chart showing a first embodiment of a printing operation including a non-jetting drive.

In a first example shown in FIG. 6, when a printing instruction is inputted (S1), an operation for printing an image data stored in the image memory 25 and corresponding to one line is started. At this time, by the drive of the carriage motor 47, the carriage 9 moves along the recording paper P in the left and right directions (moving step; S2). In addition, the control circuit 22 read out the image data stored in the image memory 25 successively, corresponding to the moving direction of the carriage 9 (the direction in which the carriage 9 moves), the control circuit 22 converts the read-out image data to a printing data signal DATA, and the control circuit 22 transmits the printing data signal DATA to the drive circuit 49. Based on the transmitted printing data signal DATA, the drive circuit 49 applies the drive pulse selectively to the actuator 31, thereby executing the printing (jetting step) (S2).

In such a manner, the printing operation is repeated while the carriage is moving once in outgoing route in the moving direction (S3). Then, when the printing operation for one movement is completed, vibration is given to the ink inside the nozzle openings without jetting the ink from the nozzles (vibrating step) (S4) in a subsequent movement in the returning route (moving step; S4). For example, in a printing mode for printing, for example, a photograph image, for which high resolution is required, the printing is performed only in the outgoing moving route, and this non-jetting drive is performed in the returning moving route.

In the non-jetting drive (S4), a drive data signal, which is equivalent to the printing data signal DATA with respect to all the nozzles, and the waveform data for the non-jetting drive pulses 50*a* to 50*c* (see FIG. 5B) are read out from the ROM 12 in accordance with the program stored in the ROM 12; and then a non-jetting drive pulse is outputted from the drive circuit 49 based on the signals read out from the ROM 12 so as to drive the actuator 31. In this case, as described above, the ink is not jetted from the nozzles, and the operation (non-jetting drive) for imparting vibration to the ink meniscus in the vicinity of the nozzle openings is executed in one outgoing moving route. As described above, a stop-period (break interval) corresponding to 100 to 150 cycles is included in one block of the non-jetting drive. Then, when the carriage is returned again to the print-start position, a judgment is made whether or not printing of all the printing data has been completed (S5). When there still is a data to be printed, the series of the printing operations is executed; and when all the data has been printed, the printing operation is completed.

Figure 7:
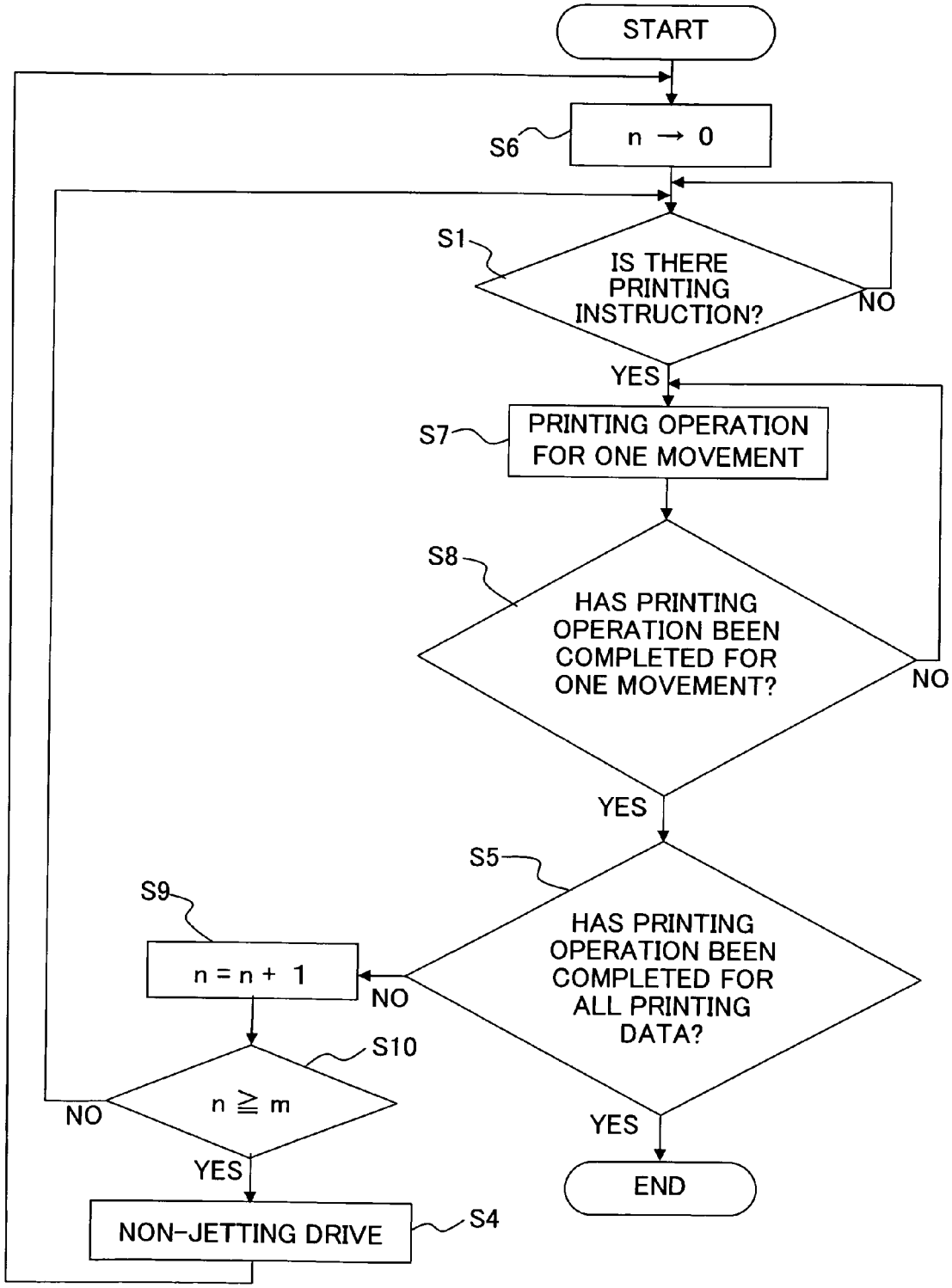
FIG. 7 is a flow chart showing a second embodiment of the printing operation including the non-jetting drive.

In a second example of the printing control as shown in FIG. 7, the jetting drive and the non-jetting drive are controlled based on the moving-count of the carriage 9. The ROM 12 stores a program which functions as a counter (S6, S9, S10). The counter measures a moving-count "n" (moving number "n") of the carriage 9 in a group (set) of printing operations. Here, the moving-count "n" is resetted to "0 (zero)" at a point of time when the preliminary jetting step has been completed after the start of the printing operation (S6).

Next, a judgment is made whether or not there is a printing instruction (S1), and when there is the printing instruction, the carriage 9 performs a printing operation corresponding to one movement (S7). Afterwards, a judgment is made whether or not the printing operation corresponding to one movement has been completed (S8), and when the printing operation corresponding to one movement has been completed, a judgment is made at this timing whether or not the printing has been completed for all the printing data (S5).

On the other hand, when the printing has not been completed for all the printing data, a next movement is started. Therefore, "1" is added to the moving-count "n" of the carriage 9 (S9). Namely, "n+1" is assigned to the moving-count "n". Then, a judgment is made whether or not the moving-count "n" reaches a specified (preset) value "m" (for example, 30 counts) (S10). When the moving-count does not reach the specified value "m", then the set of printing operations is repeated. On the other hand, when the moving-count "n" reaches the specified value "m", then the non-jetting drive is performed while making the carriage perform one movement (S4). Afterwards, the moving-count of the carriage 9 is resetted to "0", and further a series of the printing operations is repeated in accordance with a printing instruction. The printing operation is further continued and when the moving-count "n" of the carriage 9 reaches the specified value "m" again, then the non-jetting drive is performed while making the carriage perform one movement or move once (S4). Afterwards, when the printing has been finished for all the printing data (S5: YES), then the printing operation is completed. Note that when the printing is completed for all the printing data on the outgoing moving route of the carriage 9, it is allowable that the carriage is returned to the print-start portion while performing the non-jetting during one movement on the returning route, then the printing operation is completed.

Figure 8:
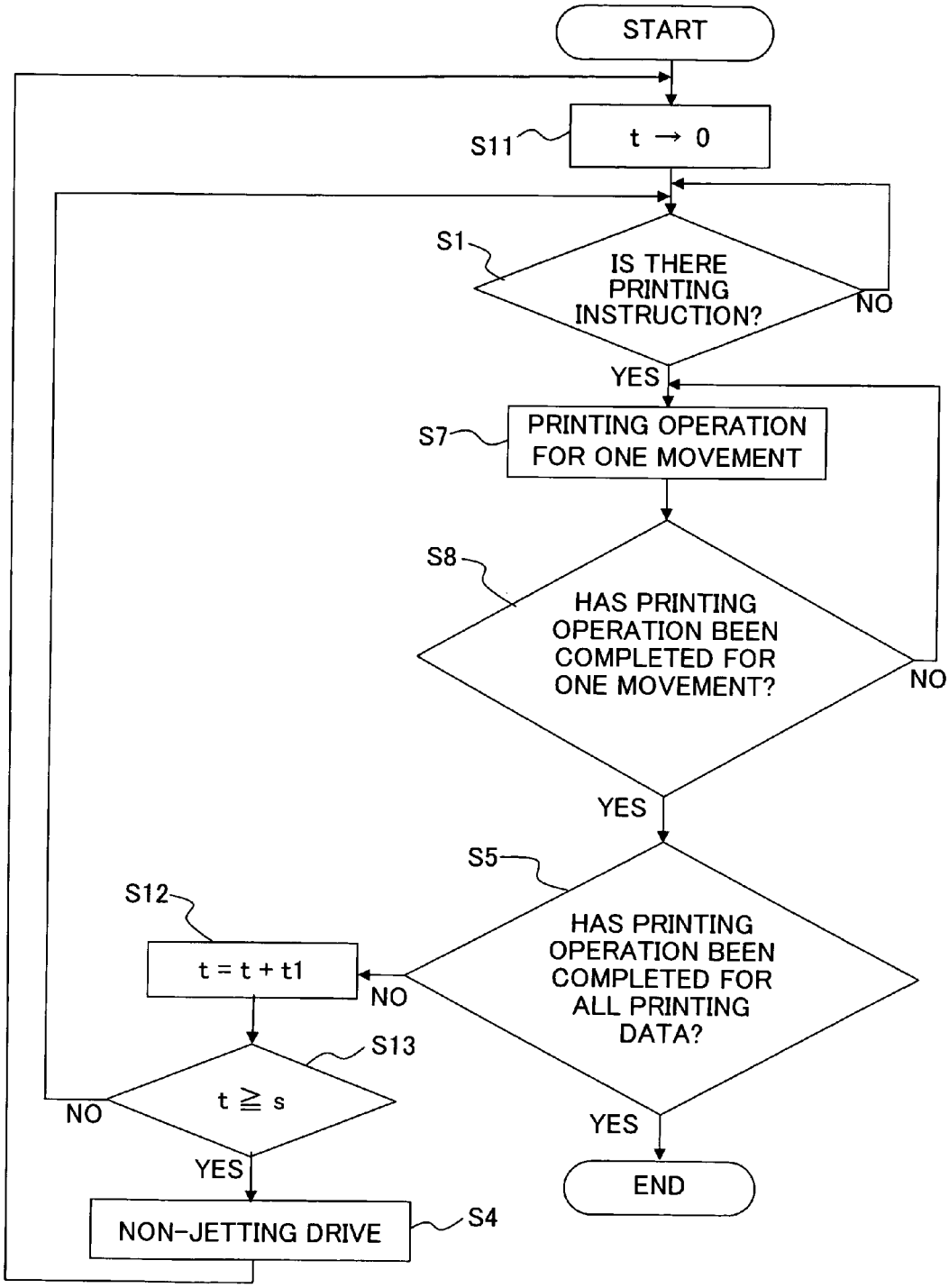
FIG. 8 is a flow chart showing a third embodiment of the printing operation including the non-jetting drive.

In a third example shown in FIG. 8, the printing control is performed by an elapsed time elapsed since the last time the flushing operation is performed for the recording head, instead of the control performed by the moving-count of the carriage. The ROM 12 stores a program which functions as a timer (S11, S12, S13). The timer measures an elapsed time "t (s)" elapsed since a point of time at which the recording head 30 has performed the flushing operation last time. Here, the elapsed time "t" is resetted to "0 (zero)" at a time when the above-described preliminary jetting operation has been completed after the start of the printing operation (S1). Steps S1, S7, S8, S5 and S4 are same as those in the above-described example; and when the printing has not been completed for all the printing instructions, a confirmation is made about an elapsed time "t1" elapsed since the time at which the preliminary jetting operation has been performed last time, and "t+t1" is assigned to the elapsed time "t" (S12). Then, a judgment is made whether or not the elapsed time "t" elapsed since the preliminary jetting performed the last time is not less than a specified (preset) value "s" (for example, 5 seconds) (S13). When the elapsed time does not reach the specified value "s", then a set of printing operations is performed. On the other hand, when the elapsed time reaches the specified value "s", then the non-jetting drive is performed while making the carriage perform one movement (S4), and the elapsed time "t" is resetted. Afterwards, a series of the printing operations is repeated based on the printing instruction. The printing operating is further continued, and when the elapsed time "t" reaches again the specified value "s", then the non-jetting is performed while making the carriage perform one movement (S4).

As described above, it is possible to impart vibration to the ink meniscus in the vicinity of the nozzles with the non-jetting drive by utilizing a time during which the carriage moves once. Accordingly, without performing the flushing operation frequently, it is possible to prevent substantially constantly the ink meniscus from being dried and the ink from becoming viscous, thereby preventing the recording quality from lowering or depredating. In particular, with respect to a recording medium such as postcard having a narrow width, there is no need to move the carriage by a distance greater than the width of the postcard unnecessarily for the flushing operation. Accordingly, it is also possible to suppress the lowering of printing speed and unnecessary consumption of the ink. Moreover, the non-jetting drive is performed also to a nozzle or nozzles 15, among the plurality of nozzles 15 formed in the recording head 30, from which the ink is jetted less frequently. Accordingly, the ink, which tends to be particularly viscous in such a less-frequently used nozzle, can be effectively agitated.

Note that in the above embodiment, when the non-jetting drive pulse is applied to the actuator, three non-jetting drive pulses are applied in one printing cycle. However, the number of the non-jetting drive pulses included in one printing cycle is not limited to three, and may be arbitrary. Further, although the printing frequency is 26 kHz in the embodiment, the frequency may also be arbitrary. Furthermore, the carriage is made to move in the width direction of the recording medium, the moving direction may be arbitrary such as the longitudinal direction of the recording medium. Moreover, in the embodiment, the non-jetting drive is performed after the jetting drive is performed. However, it is also allowable that the non-jetting drive is performed first once or a plurality of times, then the jetting drive is performed.

As described above, the present invention has been explained an ink-jet printer as an example. However, the present invention is also applicable to an apparatus which coats a coloring liquid in a form of a minutely small liquid droplet, or the like. For example, the liquid-droplet jetting apparatus of the present invention is not limited to an ink-jet head which jets an ink, and is also applicable to a liquid-droplet jetting apparatus which jets a liquid other than ink such as a reagent, a biomedical solution, a wiring material solution, electronic material solution, a cooling medium (refrigerant), a fuel, and the like.

What is claimed is:

1. A liquid-droplet jetting apparatus which jets liquid droplets of a liquid onto a medium, the apparatus comprising:

a head having an actuator which applies a pressure to the liquid and a plurality of nozzles which jet the liquid droplets;

a carriage which is provided with the head and which moves in a predetermined direction; and a controller which performs a first control in which a jetting drive pulse is supplied to the actuator so as to jet the liquid droplets from the nozzles onto the medium while the carriage moves in the predetermined direction;

wherein the controller additionally performs a second control in which, while the carriage moves in the predetermined direction, a non-jetting drive pulse is supplied to the actuator so as to impart vibration to a meniscus of the liquid in the vicinity of the nozzles without jetting the liquid droplets from the nozzles;

wherein the controller controls the carriage to move reciprocally, in an outgoing route and a returning route, in the predetermined direction;

wherein the controller performs the first control while the carriage moves in at least one of the outgoing route and the returning route;

wherein the controller performs the second control continuously during a period, encompassing an entire time from start to stop of a continuous movement, in which the carriage moves in at least one of the outgoing route and the returning route, without performing the first control during the period.

2. The liquid-droplet jetting apparatus according to claim 1;

wherein the predetermined direction is a width direction of the medium; and wherein the controller performs the second control after performing the first control.

3. The liquid-droplet jetting apparatus according to claim 2;

wherein the controller performs the first control while the carriage moves in the outgoing route and performs the second control while the carriage moves in the returning route.

4. The liquid-droplet jetting apparatus according to claim 2;

wherein the controller further includes a counter which measures a moving-count of the carriage; and wherein the controller performs the second control when the moving-count reaches a predetermined value.

5. The liquid-droplet jetting apparatus according to claim 2, further comprising:

a maintenance mechanism which performs maintenance for the head;

wherein the controller has a timer which measures an elapsed time elapsed since last time the maintenance has been performed for the head, and the controller performs the second control when the elapsed time reaches a predetermined period of time.

6. A liquid-droplet jetting apparatus which jets liquid droplets of a liquid onto a medium, the apparatus comprising:

a head having an actuator which applies a pressure to the liquid and a plurality of nozzles which jet the liquid droplets;

a carriage which is provided with the head and which moves in a predetermined direction; and a controller which performs a first control in which a jetting drive pulse is supplied to the actuator so as to jet the liquid droplets from the nozzles onto the medium while the carriage moves in the predetermined direction;

wherein the controller additionally performs a second control in which, while the carriage moves in the predetermined direction, a non-jetting drive pulse is supplied to the actuator so as to impart vibration to a meniscus of the liquid in the vicinity of the nozzles without jetting the liquid droplets from the nozzles; and wherein in the second control, the controller repeats, at a predetermined frequency, a series of operations in which supply of the non-jetting drive pulse to the actuator is repeated predetermined times and then the supply of the non-jetting pulse is stopped for a predetermined supply-stop period.

7. The liquid-droplet jetting apparatus according to claim 6;

wherein the predetermined times are three times; and wherein the predetermined frequency is 26 kHz.

8. The liquid-droplet jetting apparatus according to claim 1;

wherein a voltage of the jetting drive pulse is greater than a voltage of the non-jetting drive pulse.

9. The liquid-droplet jetting apparatus according to claim 1 which is an ink-jet printer;

wherein the liquid includes black, cyan, magenta and yellow inks.

10. A liquid-droplet jetting method for jetting liquid droplets of a liquid onto a medium by using a liquid-droplet jetting apparatus which includes: a head having an actuator which applies a pressure to the liquid and a plurality of nozzles which jet the liquid droplets; and a carriage which is provided with the head and which moves in a predetermined direction; the method comprising:

a moving step in which the carriage moves reciprocally, in an outgoing route and a returning route, in the predetermined direction;

a jetting step for jetting the liquid droplets onto the medium while the carriage moves in at least one of the outgoing route and the returning route; and a vibrating step for imparting vibration to a meniscus of the liquid in the vicinity of the nozzles, the vibrating step being performed during a period, encompassing an entire time from start to stop of a continuous movement, in which the carriage moves in at least one of the outgoing route and the returning route, without performing the jetting step during the period.

11. The liquid-droplet jetting method according to claim 10;

wherein the vibrating step is performed after the jetting step.

12. The liquid-droplet jetting method according to claim 11;

wherein in the jetting step, the liquid droplets are jetted onto the medium while the carriage moves in one of the outgoing route and the returning route in the predetermined direction; and wherein in the vibrating step, the vibration is imparted to the meniscus while the carriage moves in the other of the outgoing route and the returning route in the predetermined direction.

13. The liquid-droplet jetting method according to claim 10, further comprising:

a step for measuring a moving-count of the carriage;

wherein when the moving-count reaches a predetermined value, the vibration step is performed.

14. A liquid-droplet jetting method for jetting liquid droplets of a liquid onto a medium by using a liquid-droplet jetting apparatus which includes: a head having an actuator which applies a pressure to the liquid and a plurality of nozzles which jet the liquid droplets; and a carriage which is provided with the head and which moves in a predetermined direction; the method comprising:

a moving step in which the carriage moves in the predetermined direction;

a jetting step for jetting the liquid droplets onto the medium while the moving step is being performed; and a vibrating step for imparting vibration to a meniscus of the liquid in the vicinity of the nozzles while the moving step is being performed;

wherein in the vibration step, a series of operations, in which a non-jetting drive pulse is supplied to the actuator repeatedly for predetermined times and then the non-jetting drive pulse is not supplied for a predetermined supply-stop period, is repeated at a predetermined frequency.

15. The liquid-droplet jetting method according to claim 14;

wherein the predetermined times are three times; and wherein the predetermined frequency is 26 kHz.

16. The liquid-droplet jetting method according to claim 10;

wherein in the jetting step, a voltage of the jetting drive pulse is greater than a voltage of the non-jetting drive pulse in the vibrating step.

17. The liquid-droplet jetting apparatus according to claim 1;

wherein, after the first control is performed while the carriage moves in at least one of the outgoing route and the returning route, the carriage subsequently moves in the other of the outgoing route and the returning route; and wherein the controller performs the second control while the carriage subsequently moves in the other of the outgoing route and the returning route after performing the first control.

18. The liquid-droplet jetting method according to claim 10;

wherein, after the jetting step is performed while the carriage moves in at least one of the outgoing route and the returning route, the carriage subsequently moves in the other of the outgoing route and the returning route; and wherein the vibration step is performed while the carriage subsequently moves in the other of the outgoing route and the returning route after the jetting step, which the carriage moves above the medium.

* * * * *